US012298056B2

(12) United States Patent
Lepikhin et al.

(10) Patent No.: US 12,298,056 B2
(45) Date of Patent: May 13, 2025

(54) SHOCK FREEZING CABINET

(71) Applicant: Revoltech Inc., Dover, DE (US)

(72) Inventors: Igor Viktorovich Lepikhin, Nizhny Novgorod (RU); Aleksei Aleksandrovich Platonov, Zelenoborsky (RU)

(73) Assignee: Revoltech Inc., Dover, DE (US)

( * ) Notice: Subject to any disclaimer, the term of this patent is extended or adjusted under 35 U.S.C. 154(b) by 252 days.

(21) Appl. No.: 17/988,423

(22) Filed: Nov. 16, 2022

(65) Prior Publication Data

US 2024/0159448 A1 May 16, 2024

(51) Int. Cl.
*F25D 17/06* (2006.01)
*F25D 23/00* (2006.01)

(52) U.S. Cl.
CPC ..... *F25D 23/006* (2013.01); *F25D 17/06* (2013.01); *F25D 2317/063* (2013.01); *F25D 2317/0682* (2013.01); *F25D 2400/30* (2013.01)

(58) Field of Classification Search
CPC .. F25D 23/006; F25D 17/06; F25D 2317/063; F25D 2317/0682; F25D 2400/30; F25D 2317/0665
See application file for complete search history.

(56) References Cited

U.S. PATENT DOCUMENTS

2022/0252324 A1* 8/2022 Blackwood ..... F25B 13/00

FOREIGN PATENT DOCUMENTS

CN 216080542 U * 3/2022

* cited by examiner

*Primary Examiner* — Ana M Vazquez
(74) *Attorney, Agent, or Firm* — MASCHOFF BRENNAN; Paul G. Johnson

(57) ABSTRACT

An example shock freezing cabinet comprises a housing, food freezing compartment, upper and lower chambers, an evaporator and a condenser. A grill is installed in front of the chamber. Inside the lower chamber behind the grill are the condenser and a fan. Another fan and the evaporator are in the upper chamber. The evaporator is configured in the form of pipes that are round in cross-section and is located along a back wall. The pipes are positioned with equal pitch in a zigzag pattern in parallel rows. The fan is between sections of the evaporator. On the upper chamber rear wall there are air flow deflectors with protruding walls positioned at negative angle to a fan axis directed to the rear wall configured to reflect and re-direct the air flows from the fan to eliminate "stagnant" areas and to ensure circulation of cold air mass directed to cooled food.

9 Claims, 5 Drawing Sheets

A - A direction of pumped air motion direction of pressurized cooling agent motion gaseous state of cooling agent liquid state of cooling agent de-moisturized liquid cooling agent

SHOCK FREEZING CABINET

The invention relates to the field of refrigerating appliances, and in particular, to thermal electrical conditioning and chilling-freezing appliances used for shock freezing of food stuff [F25D 1/00, F25B 39/02, F25B 39/04].

The prior art discloses APACH SH07 SHOCK FREEZING CABINET [https://market.yandex.ru/product-shkaf-shokovoi-zamorozki-apach-sh07/652302277?cpc=QHUvnBGPYOnUxLvi_Oxed2AubnDiJFZTidONKkNo8BgnOgiarLxzEqzsIUZ77V5rVnLqEUUGywWkOg3WqJEADWm7CGxT4FEx11B3NwJEBOcBHmx29RLG5SjDK9htwqEqpheIZcR0FvkKWneFqaCLKf5eGYjagzfo4c85uSU-REz4%2C&clid=2355927&sku=100870928167&offerid=x_Fbo95Bah2KDMSRUd6mtQ&cpa=1], comprising a housing, a chamber with evaporator, a chamber with a condenser, both accommodating fans, and a food cooling compartment. Side walls of the food cooling compartment comprise horizontal guides for food trays.

However, the afore appliance has a drawback:

- intake by the fan of hot air exiting the chamber with condenser and re-direction of hot air onto condenser pipes;
- inefficient cooling of evaporator due to poor aerodynamics;
- movement of cooling agent in lower parts of condenser and evaporator pipes.

The prior art discloses POLAIR CR3-L (CR5-L) SHOCK FREEZING CABINET [https://www.refro.ru/product/shkaf-shokovov-zamorozki-polair-cr3-1/], comprising a housing, a chamber with evaporator, a chamber with a condenser, both accommodating fans, and a food cooling compartment. Side walls of the food cooling compartment comprise horizontal guides for food trays.

However, the afore appliance has a drawback:

- intake by the fan of hot air exiting the chamber with condenser and re-direction of hot air onto condenser pipes;
- inefficient cooling of evaporator due to poor aerodynamics;
- movement of cooling agent in lower parts of condenser and evaporator pipes.

The closest prior art is CR 15-G SHOCK FREEZING APPARATUS [https://remtogholod.ru/catalog/kholodilnoe-oborudovanie/shkafy-shokovoy-zamorozki/apparat-shokovov-zamorozki-cr-15-g-pravoe-otkryvanie-dveri/], comprising a housing, a food freezing compartment, an upper and a lower chambers both accommodating the fans, an evaporator, and a condenser. The side walls of the food freezing compartment are provided with horizontal guides for trays with food. The front lower part of the housing has a grill installed in front of the chamber.

However, the afore appliance has a drawback:

- intake by the fan of hot air exiting the chamber with condenser and re-direction of hot air onto condenser pipes;
- inefficient cooling of evaporator due to poor aerodynamics;
- movement of cooling agent in lower parts of condenser and evaporator pipes.

The effect of the invention is to ensure aerodynamic processes of air movement, to improve cooling of the condenser and to withdraw cold air mass from the evaporator.

The said effect is achieved due to the shock freezing cabinet comprising a housing, a food freezing compartment, an upper and a lower chamber both accommodating fans installed therein, an evaporator and a condenser, a grill mounted in the front lower part of the housing, the said grill having the condenser and the fan mounted behind the grill in the inner space of the lower chamber, the evaporator and the fan mounted inside the upper chamber, wherein the evaporator is of a sectional type in the form of pipes that are round in cross-section, the said evaporator located along the back wall symmetrically on both sides of the upper chamber relative to its vertical axis of symmetry in the same plane with the fan, the evaporator pipes being positioned with equal pitch as per a zigzag pattern in parallel rows, the fan being mounted between the evaporator sections; behind the fan on the upper chamber rear wall along its height and along the axis coinciding with the fan axis and in the rear corners of the upper chamber, there are air flow deflectors with protruding walls positioned at negative angle to the fan axis directed to the rear wall configured to reflect and re-direct the air flows from the fan so as to eliminate "stagnant" areas and to ensure circulation of cold air mass directed to the cooled food, the housing further mounting a compressor, a receiver, a dehydrating filter, solenoids, and restricting elements.

More particularly, the fan is installed in the lower chamber without any clearances between the side walls and the top and bottom bases of the lower chamber, while the condenser is mounted in front of the fan.

More particularly, the condenser is configured in the form of horizontally positioned in a zigzag parallel rows of pipes that are round in cross-section, the said condenser being positioned between the side walls of the lower chamber.

More particularly, inside the lower chamber the condenser is installed in the cavity of a front part of a cylindrical casing provided with a conical apron, and the fan is installed behind the condenser inside the cavity of a cylindrical casing.

More particularly, the condenser is configured in the form of spiral coiled pipes of round section with equal coiling pitch, the crossing center of symmetry axes thereof coincides with the fan blades rotation axis.

More particularly, the air flow deflector installed behind the fan in its cross-section has a form of an equilateral triangle with its apex coinciding with the vertical symmetry axis of the upper chamber.

More particularly, the air flow deflector installed behind the fan in its cross-section has a 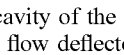 -shape with its apex coinciding with the vertical symmetry axis of the upper chamber, while the concave sides of the said deflector are directed towards the inner cavity of the upper chamber.

More particularly, the air flow deflectors installed in the back corners of the upper chamber in their cross-section have a form of a right-angled triangle.

More particularly, the air flow deflectors installed in the back corners of the upper chamber in their cross-section have a 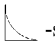 -shape with the concave sides directed towards the inner cavity of the upper chamber.

The figures have the following designations: 1—housing, 2—food freezing compartment, 3—upper chamber, 4—lower chamber, 5, 6—fans, 7—evaporator, 8—condenser, 9—grill, 10, 11—air flow deflectors, 12—cylindrical casing, 13—conical apron, 14—compressor, 15—receiver, 16—dehydrating filter, 17, 18—solenoids, 19, 20—restricting elements.

EMBODIMENT OF INVENTION

Figure 1:
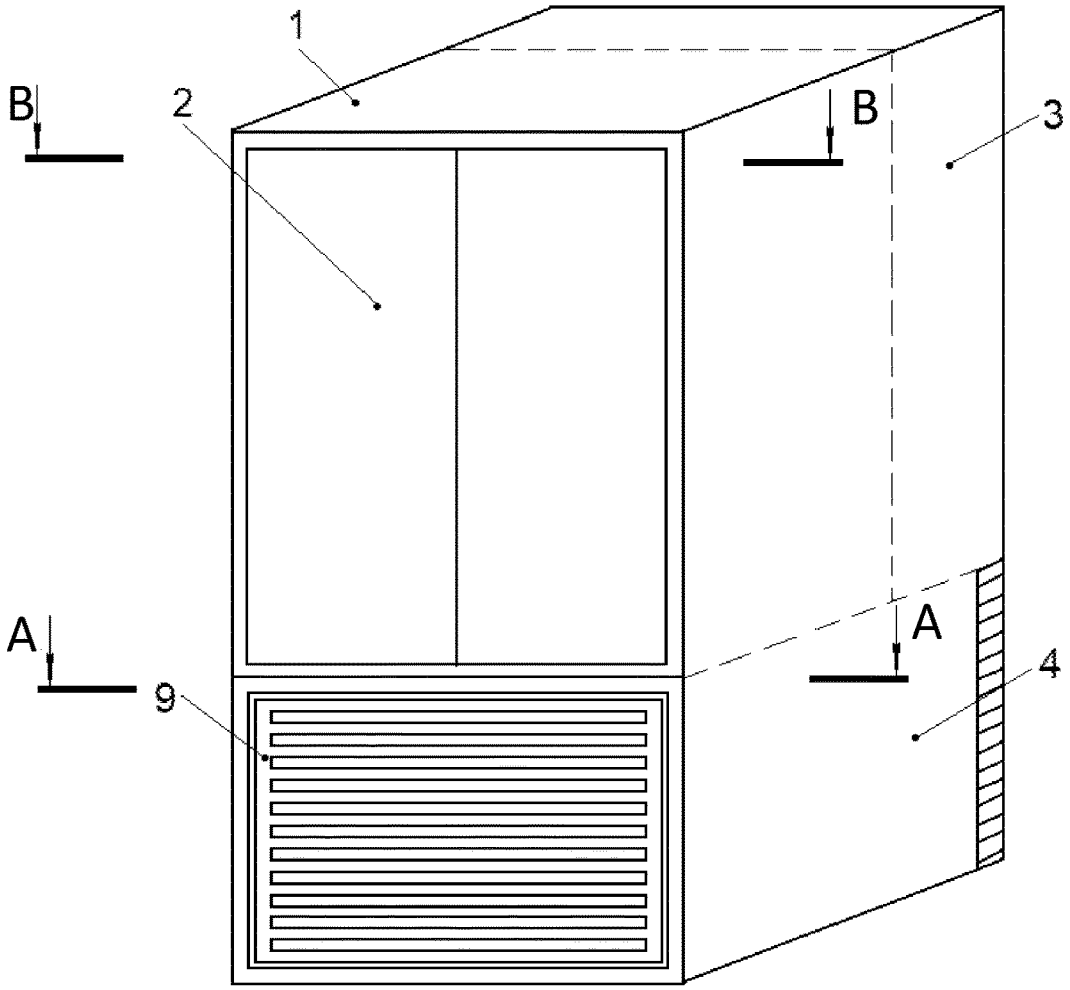
FIG. 1 presents the shock freezing cabinet, general view.

The shock freezing cabinet comprises the housing 1, food freezing compartment 2, the upper 3 and the lower 4 chamber both accommodating the fans 5, 6, the evaporator 7 and the condenser 8. The front lower part of the housing 1 has a grill 9 installed in front of the lower chamber 4 (see FIG. 1, 2, 3).

Figure 2:
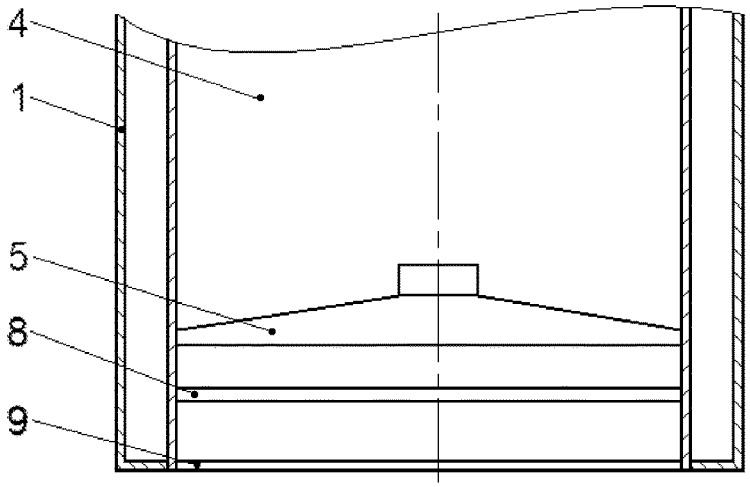
FIG. 2 presents a cross-section of the lower chamber along A-A plane.

Condenser 8 and fan 5 are installed inside the lower chamber 4 behind the grill 9 (see FIG. 2).

Figure 4:
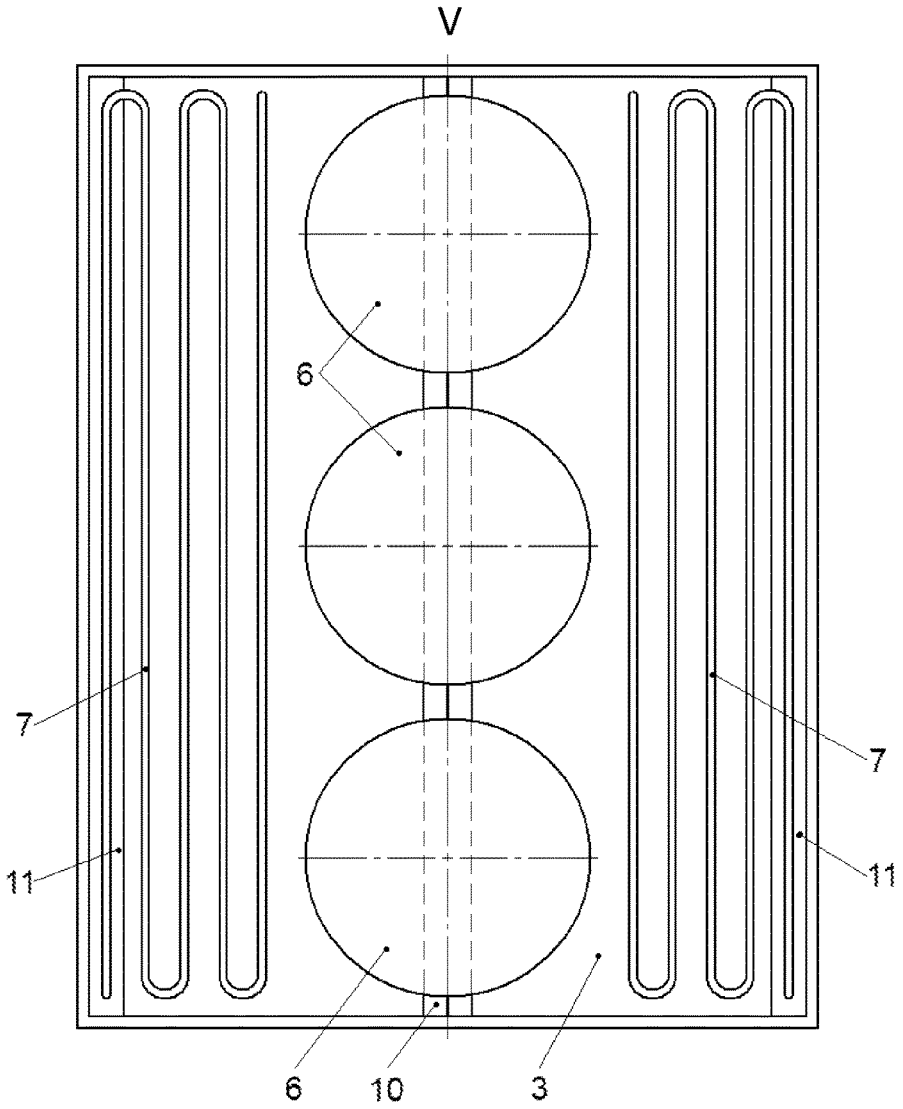
FIG. 4 presents the upper chamber, view B.

The fan 6 and evaporator 7 are installed in the upper chamber 3. The evaporator 7 is configured in the form of pipes that are round in cross-section, the said evaporator located along the back wall symmetrically on both sides of the upper chamber 3 relative to its vertical axis of symmetry in the same plane with the fan 6. The pipes of evaporator 7 are positioned with equal pitch as per a zigzag pattern in parallel rows. The fan 6 is installed between the sections of evaporator 7. Behind the fan 6 on the upper chamber 3 rear wall along its height and along the axis coinciding with the fan 6 axis and in the rear corners of the upper chamber 3 there are air flow deflectors 10, 11 with protruding walls positioned at negative angle to the fan 6 axis directed to the rear wall configured to reflect and re-direct the air flows from the fan 6 so as to eliminate "stagnant" areas and to ensure circulation of cold air mass directed to the cooled food (see FIG. 4).

Figure 7:
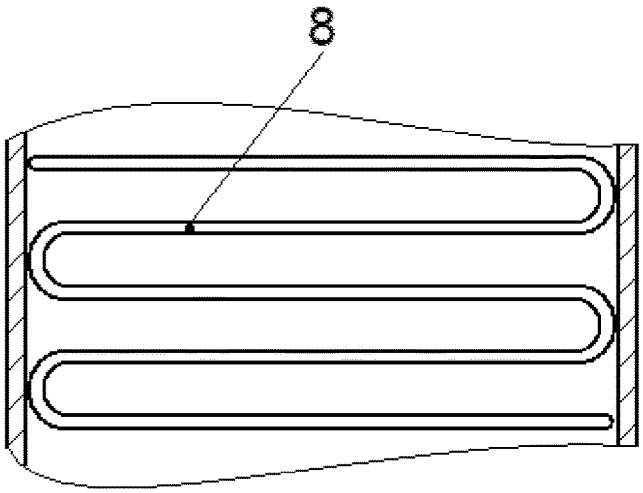
FIG. 7 presents the condenser in the form of horizontally positioned in zigzag pattern parallel rows of pipes.

More particularly, the fan 5 is installed in the lower chamber 4 without any clearances between the side walls and the top and bottom bases of the lower chamber 4, while the condenser 8 is mounted in front of the fan 5 (see FIG. 2). The condenser 8 is configured in the form of horizontally positioned in a zigzag pattern parallel rows of pipes that are round in cross-section, the said condenser 8 being positioned between the side walls of the lower chamber 4 (see FIG. 7).

Figure 6:
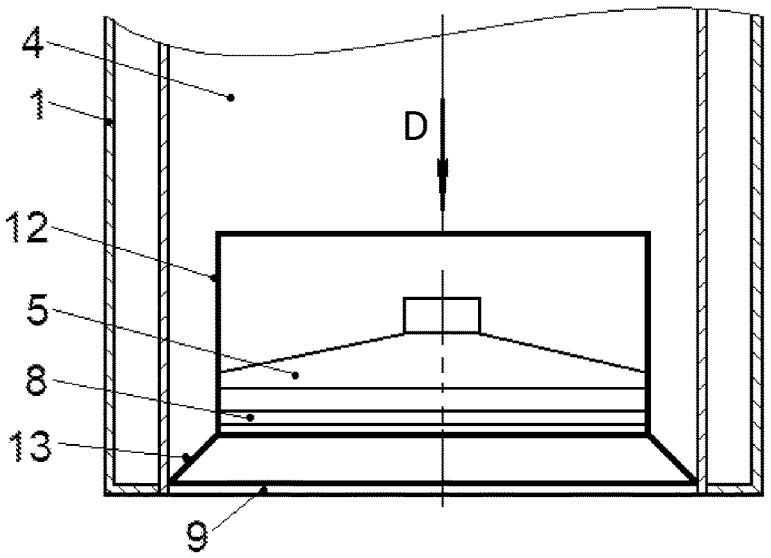
FIG. 6 presents location of the fan and condenser in the cylindrical casing.
Figure 8:
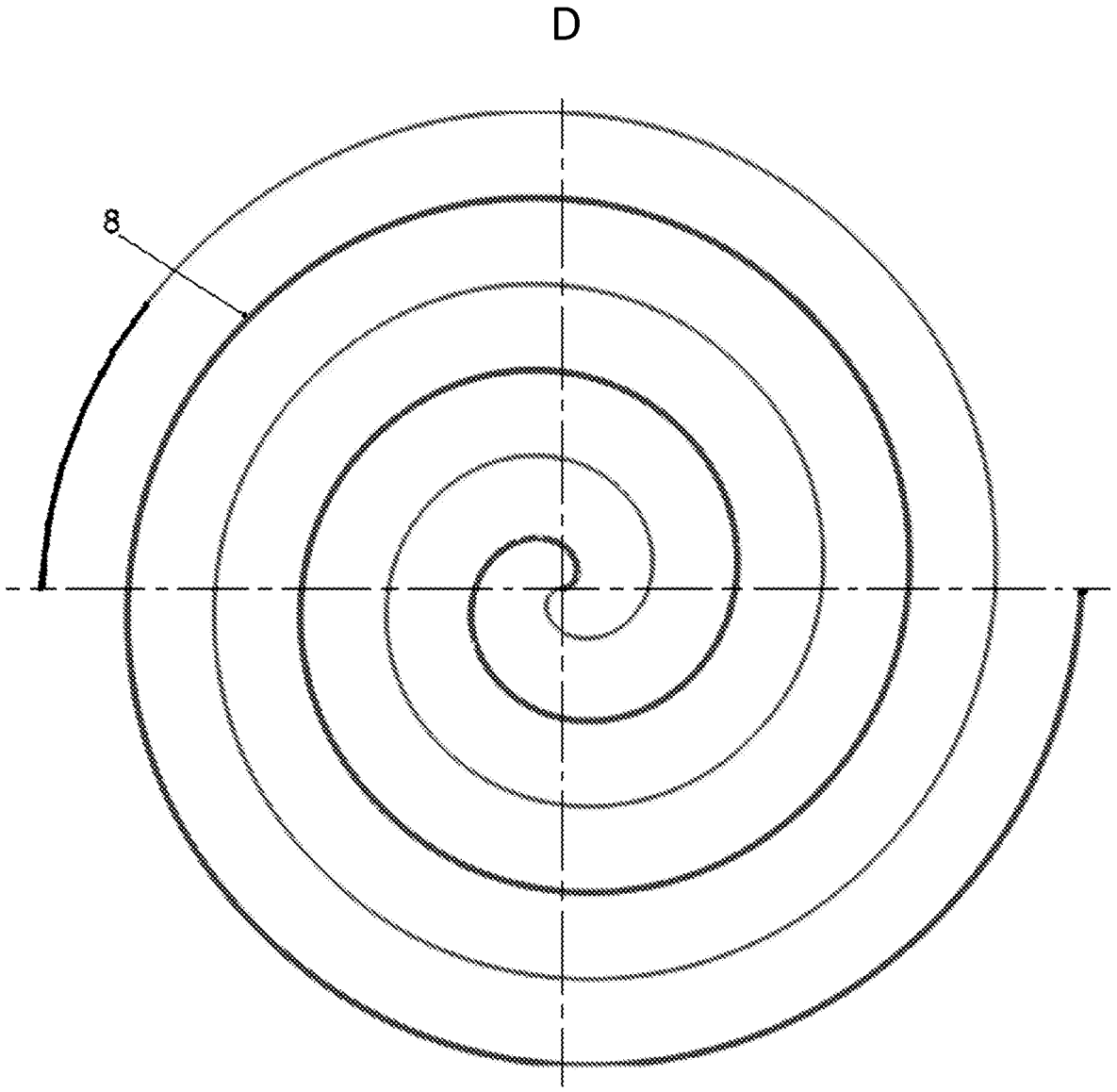
FIG. 8 presents the condenser in the form of spiral coiled pipes.
Figure 9:
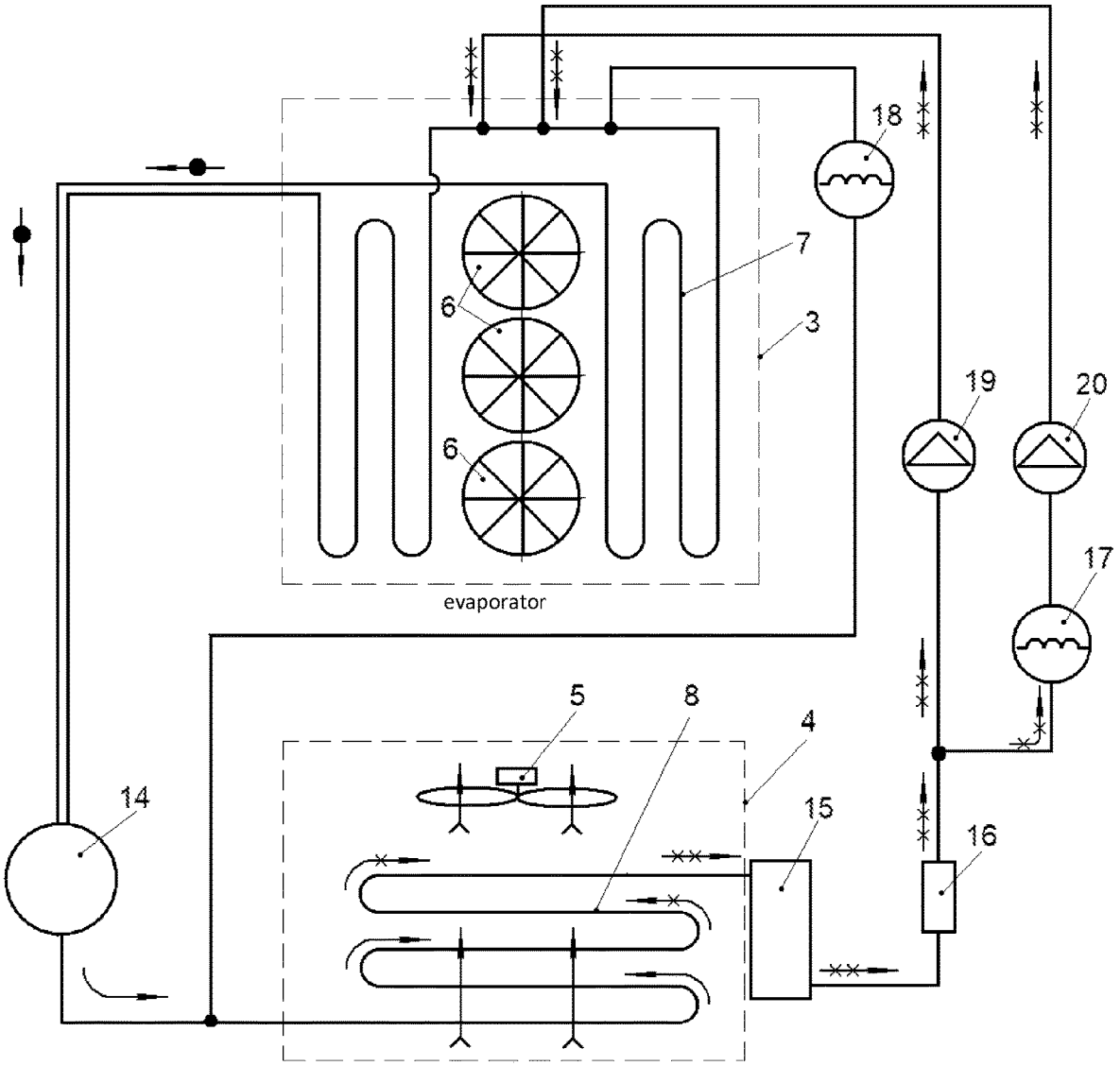
FIG. 9 presents the operation diagram of shock freezing cabinet.

More particularly, inside the lower chamber 4 the condenser 8 is installed in the cavity of a front part of a cylindrical casing 12 provided with a conical apron 13, and the fan 5 is installed behind the condenser 8 inside the cavity of a cylindrical casing 12 (see FIG. 6). In this respect, the condenser 8 may be configured in the form of spiral coiled pipes of round section (see. FIG. 8) with equal coiling pitch, the crossing center of symmetry axes thereof coincides with the blades rotation axis of fan 5.

Figure 3:
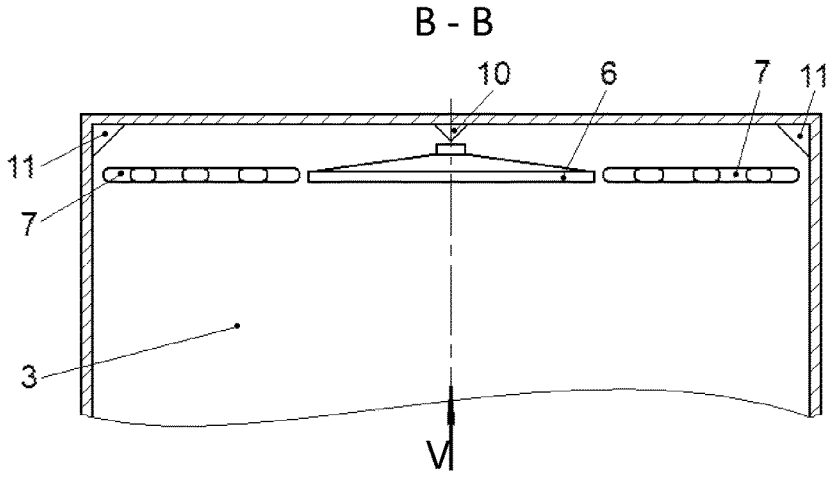
FIG. 3 presents a cross-section of the upper chamber along B-B section.
Figure 5:
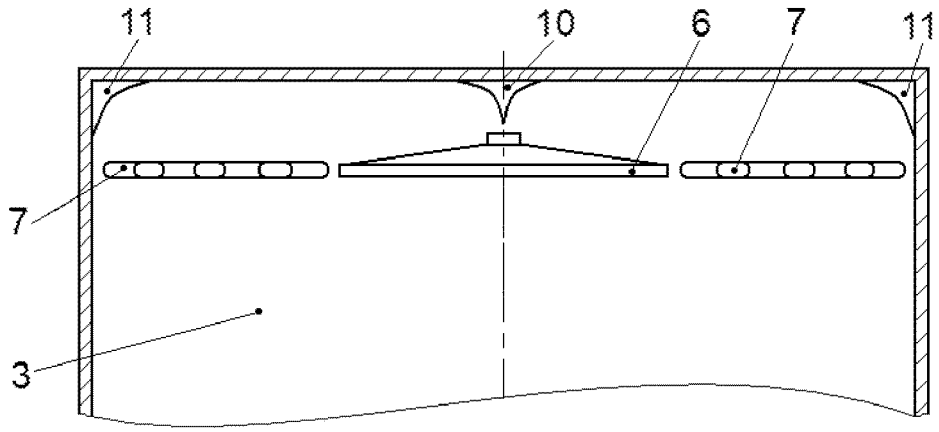
FIG. 5 presents location of deflectors in the upper chamber, top view.

The air flow deflector 10 installed behind the fan 6 may have in its cross-section a form of an equilateral triangle (see FIG. 3) with its apex coinciding with the vertical symmetry axis of the upper chamber 3, or a 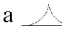 -shape (see FIG. 5) its apex coinciding with the vertical symmetry axis of the upper chamber 3, while the concave sides of the said deflector are directed towards the inner cavity of the upper chamber 3.

The air flow deflectors 11 installed in the back corners of the upper chamber 3 in their cross-section may have a form of a right-angled triangle (see FIG. 3) or a 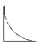 -shape (see FIG. 5) and are directed with their concave side towards the inner cavity of the upper chamber 3.

The housing 1 is further mounting compressor 14, receiver 15, dehydrating filter 16, solenoids 17, 18 and restricting elements 19, 20.

The shock freezing cabinet operates as follows:

Compressor 14 connected to the electric power line withdraws the gaseous cooling agent from evaporator 7 and compresses the said agent. Further, pressurized cooling agent is directed by compressor 14 to the condenser 8. In condenser 8 the cooling agent that was heated during compression is condensed due to flow of air created by fan 5 and finally converts to a liquid state.

Further, the pressurized liquid cooling agent passes through the receiver 15 and dehydrating filter 16, solenoid 17, restricting element 19, 20 and arrives to evaporator 7 wherein it is converted from liquid to gas. Due to such phase transformation the cooling agent starts to adsorb the thermal energy and lowers the temperature of the cooling agent and evaporator as well as the air around the pipes of evaporator 7. Therefore, the temperature inside the food freezing compartment decreases as well due to 2 decreases, and the temperature of food inside the compartment decreases as well due to uniform distribution of cold air flow provided from evaporator 7 by fan 6.

Further on, the compressor 14 withdraws the gaseous cooling agent from evaporator 7 and compresses the said agent. And the cycle is repeated thereafter.

Presence of the compressor 14 in the shock freezing cabinet allows to compress the cooling agent and ensure phase transformation of the cooling agent from gaseous to liquid state and transport it.

Receiver 15 allows to maintain the required quantity of circulating cooling agent in the system and, subsequently, provide for different operation modes of the shock freezing cabinet.

Dehydrating filter 16 ensures removal of moisture from the cooling agent and protects the system from pollution with solid particles.

Solenoid 17 provides for automatic opening or closing of the refrigeration circuit when ensuring circulation of liquid cooling agent or hot vapors of cooling agent.

Presence of solenoid 18 located in the line between the compressor 14 and evaporator 7 allows to reduce the time needed for freezing of food in the food freezing compartment 2 from 240 minutes as it is accepted for existing shock freezing cabinets to 120 minutes as in the claimed invention.

Restricting elements 19, 20 are necessary to regulate the amount of the cooling agent coming to the evaporator depending on the overheating on the evaporator.

Construction of the evaporator 7 as a sectional type one in the form of round pipes and location of the said evaporator 7 along the back wall symmetrically on both sides of the upper chamber 3 relative to its vertical axis of symmetry in the same plane with the fan 6, wherein the fan 6 is mounted between the sections of evaporator 7, allows to guarantee the aerodynamical processes of air flow in the upper chamber 3 and to ensure uniform withdrawal of cold mass from evaporator 7 and distribution of said cold mass over the food products in the food freezing compartment 2.

Location of evaporator pipes placed vertically in zigzagging parallel rows of equal pitch allows to exclude dripping of the cooling agent during cooling into the lower semi-spheres of evaporator 7 pipes, as it is observed in existing shock freezing cabinets, thus increasing the efficiency of the cooling system operation.

Availability of air flow deflectors 10, 11 behind the fan 6 on the top of back wall of upper chamber 3 along its height and along the axis coinciding with the axis of fan 6, said deflectors 10, 11 having protruding walls positioned at negative angle to the axis of fan 6 and having in their cross-section the form of an equilateral triangle, or a 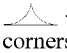 -shape (item 10) and air deflectors 11 installed in the corners of upper chamber 3 and having in their cross-section the form of a straight angle triangle or a 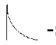 -shape allows to eliminate "stagnant" areas and to ensure circulation of cold air mass directed to the cooled food.

Configuration of the condenser 8 in the form of horizontally positioned zigzagging pipes in parallel rows of pipes that are round in cross-section, and the said condenser 8 being positioned between the side walls of the lower chamber 4, as well as installation of fan 5 in the lower chamber 4 without clearances between the side walls and the top and bottom base of the lower chamber 4 ensures cooling of the condenser 8 without additional swirling of withdrawn warm air back to the condenser 8.

Installation of the condenser 8 in front of the fan 5 ensures passage of air mass pumped by the fan 5 from the environment through pipes of condenser 8 and withdrawal of warn air mass from the housing 1.

And additionally, configuration of the condenser 8 in the form of spiral coiled pipes of round section with equal pitch between the coils, wherein the crossing center of symmetry axes thereof coincides with the fan 5 blades rotation axis, as well as installation of the condenser 8 in the lower chamber 4 within the cavity of a front part of a cylindrical casing 12 provided with a conical apron 13, and wherein the fan 5 is installed behind the condenser 8, guarantees passage of air mass pumped by the fan 5 from the environment through pipes of condenser 8 and withdrawal of warn air mass from the housing 1.

Therefore, application of the claimed apparatus will allow to ensure aerodynamical processes of air motion, improve cooling of the condenser and withdrawal of cold air mass from the evaporator.

The invention claimed is:

1. A shock freezing cabinet comprising:

a housing, a food freezing compartment, an upper and a lower chamber respectively accommodating a first fan and a second fan installed therein, an evaporator and a condenser, a grill mounted in a front lower part of the housing in front of the lower chamber, the grill having the condenser and the second fan mounted behind the grill in an inner space of the lower chamber, wherein:

the evaporator and the first fan are mounted inside the upper chamber, the evaporator is of a sectional type in the form of pipes that are round in cross-section, the evaporator is located along a back wall symmetrically on both sides of the upper chamber relative to a vertical symmetry axis of the upper chamber in a same plane with the first fan, the evaporator pipes are positioned with equal pitch as per a zigzag pattern in parallel rows, the first fan is mounted between the evaporator sections, behind the first fan on the upper chamber back wall along a height of the back wall and along an axis coinciding with a fan axis of the first fan and in rear corners of the upper chamber, there are air flow deflectors with protruding walls positioned at negative angles to the fan axis directed to the back wall configured to reflect and re-direct air flows from the first fan so as to eliminate "stagnant" areas and to ensure circulation of cold air mass directed to cooled food, the housing further mounts a compressor, a receiver, a dehydrating filter, and solenoids.

2. Shock freezing cabinet of claim 1, wherein the second fan is installed in the lower chamber without any clearances between side walls and top and bottom bases of the lower chamber, while the condenser is mounted in front of the second fan.

3. Shock freezing cabinet of claim 1, wherein the condenser is configured in the form of horizontally positioned zigzagged parallel rows of pipes that are round in cross-section, and wherein the condenser is positioned between side walls of the lower chamber.

4. Shock freezing cabinet of claim 1, wherein inside the lower chamber the condenser is installed in a cavity of a front part of a cylindrical casing provided with a conical apron, and wherein the second fan is installed behind the condenser inside the cavity of the cylindrical casing.

5. Shock freezing cabinet of claim 1, wherein the condenser is configured in the form of spiral coiled pipes of round section with equal coiling pitch, and wherein a center of the spiral coiled pipes coincides with a fan blades rotation axis.

6. Shock freezing cabinet of claim 1, wherein ach of the air flow deflectors installed behind the first fan in a cross-section of the air flow deflector has a form of an equilateral triangle with an apex of the equilateral triangle coinciding with the vertical symmetry axis of the upper chamber.

7. Shock freezing cabinet of claim 1, wherein each of the air flow deflectors installed behind the first fan in its cross-section has a peaked-shape with an apex of the peak coinciding with the vertical symmetry axis of the upper chamber, while concave sides of the air flow deflectors are directed towards an inner cavity of the upper chamber.

8. Shock freezing cabinet of claim 1, wherein the air flow deflectors installed in the rear corners of the upper chamber in their cross-section have a form of a right-angled triangle.

9. Shock freezing cabinet of claim 1, wherein the air flow deflectors installed in the rear corners of the upper chamber in their cross-section have a concave shape with concave sides directed towards an inner cavity of the upper chamber.

* * * * *